United States Patent [19]

Hawkins et al.

[11] 4,239,160

[45] Dec. 16, 1980

[54] FILM SHREDDER

[75] Inventors: William E. Hawkins; C. George Huskey, both of Circleville, Ohio

[73] Assignee: E. I. Du Pont de Nemours and Company, Wilmington, Del.

[21] Appl. No.: 39,945

[22] Filed: May 17, 1979

[51] Int. Cl.[3] ..... B02C 18/16; B02C 18/44

[52] U.S. Cl. ..... 241/222; 241/242

[58] Field of Search ..... 241/73, 221, 222, 224, 241/242

[56] References Cited

U.S. PATENT DOCUMENTS

| | | | |
|---|---|---|---|
| 1,322,210 | 11/1919 | Williams | 241/73 |
| 2,360,357 | 10/1944 | Marshall | 241/73 X |
| 2,635,693 | 4/1953 | Gibby . | |
| 2,639,096 | 5/1953 | Hinerfeld | 241/222 |
| 2,696,650 | 12/1954 | Bettes, Jr. . | |
| 2,739,647 | 3/1956 | Coste . | |
| 3,186,277 | 6/1965 | Brynner . | |
| 3,342,093 | 9/1967 | Billingsley . | |
| 3,353,754 | 11/1967 | Heijnis et al. . | |
| 3,510,067 | 5/1970 | Beck et al. . | |
| 3,545,686 | 12/1970 | Brown . | |
| 3,549,093 | 12/1970 | Pallmann | 241/73 X |
| 3,617,005 | 11/1971 | Pearson . | |
| 3,685,751 | 8/1972 | Anders . | |
| 3,806,047 | 8/1974 | Ober . | |
| 3,806,048 | 8/1974 | Williams . | |
| 3,823,877 | 7/1974 | Poggie . | |
| 3,960,334 | 6/1976 | Wudyka | 241/73 X |
| 4,004,738 | 1/1977 | Hawkins . | |
| 4,028,779 | 6/1977 | Shah . | |
| 4,030,865 | 6/1977 | Kobayashi | 241/73 X |
| 4,069,981 | 1/1978 | Shah . | |

*Primary Examiner*—Howard N. Goldberg

[57] ABSTRACT

A device is disclosed for smoothly, continuously, and more effectively shredding laterally-extended film material of indefinite length without jerking the film material into the device with excessive force. Cooperating cutting edges are used—one serrated, another smooth.

7 Claims, 7 Drawing Figures

FILM SHREDDER

DESCRIPTION

Technical Field

This invention relates to a device for shredding laterally-extending film material of indefinite length at a high rate and in a smooth and continuous manner without jerking the film material with excessive force as it is introduced into the device.

BACKGROUND ART

U.S. Pat. No. 3,545,686 issued Dec. 8, 1970 on the application of G. N. Brown, discloses a film shredding device wherein film to be shredded is fed through a pair of cooperating saw-toothed blades, one of which is stationary and the other of which rotates therepast in interdigitated relation. At each passing of the blades, film is said to be pierced and torn. The device, with its blades of interdigitated teeth, requires careful attention to blade clearances and frequent adjustment of those clearances.

U.S. Pat. No. 4,004,738 issued Jan. 25, 1977 on the application of W. E. Hawkins, discloses a film shredding device wherein a film web of narrow width is pierced and torn by being pulled across a stationary, free-standing, saw-toothed blade and the torn film is then cut or further torn by being fed through pairs of closely-spaced, smooth-edged blades. While the device of that patent is said to reduce the tendency for jerking the input film material, use of the device is inherently limited to narrow film widths because the shredding element of that device is required to have a diameter at least two times the width of the film to be shredded.

In previous shredding devices, it has been found that pairs of blades with intermeshing teeth are difficult to adjust and maintain in adjustment and pairs of blades with smooth cutting edges do not always sever all of the film which passes through. When film enters a shredding device and is incompletely cut, then the incompletely cut film is subject to being wrapped about the rotating parts of the device and to being, thereby, jerked further into the device at the speed of the rotor unless or until the film is completely severed.

SUMMARY OF THE INVENTION

The tendency for film to be jerked into a shredding device presents several difficulties. Such jerking causes accelerated wear on the machinery due to excessive stresses placed on bearings and joints and the like. Jerking forces can cause the film to be broken, necessitating machinery shut down and film rethreading. Such jerking also presents a danger to the machinery operators, in the case of feeding web material to the device by hand. An unexpected jerk on film being fed into the device could pull the operator into the machine or so put him off balance that he would fall or have some part of his clothing drawn into the device. A device which wraps film about the rotating parts and causes the film to jerk is subject to becoming clogged by the wrapped film requiring a complete shutdown of the device.

According to the present invention, there is disclosed a device for shredding laterally extended film material of indefinite length at a high rate and in a smooth and continuous manner, without excessively jerking in the material;—the device comprising a housing with an inlet and an outlet, cutting means rotatably mounted in the housing and having a smooth cutting edge, and a stationary knife having a serrated edge mounted on the housing with the serrated edge positioned at the periphery of the path, from the housing inlet to the housing outlet, of the smooth cutting edge of the rotatable cutting means and with the serrated edge directed toward the housing inlet.

To enhance the film shredding character of the device, the serrated cutting edge of the stationary knife has an arcuate surface concave toward and projecting into the housing inlet with sharply pointed teeth spaced apart in the body of the knife blade and directed against the direction of rotation of the rotatable cutting means.

DESCRIPTION OF THE DRAWINGS

In FIG. 1, the device 10 of this invention is shown in cross section with housing 11 having inlet 12 and outlet 13. Cutting means 14 is made up of flying knives 15 fixed to rotor 16 and rotatably mounted on shaft 17 inside housing 11. Flying knives 15 have smooth, sharpened, cutting edges spaced equidistant from the axis of shaft 17. Stationary knife 18 with serrated edge 19 is mounted on housing 11 and is positioned with the serrated edge 19 at the periphery 20 of the path of rotating flying knives 15. Stationary knife 18 can be fixed to a mounting block 21 which is, in turn, fixed to housing 11; and serrated edge 19 is directed toward inlet 12 against the direction of rotation of flying knives 15 and may extend into inlet 12.

Figure 1:
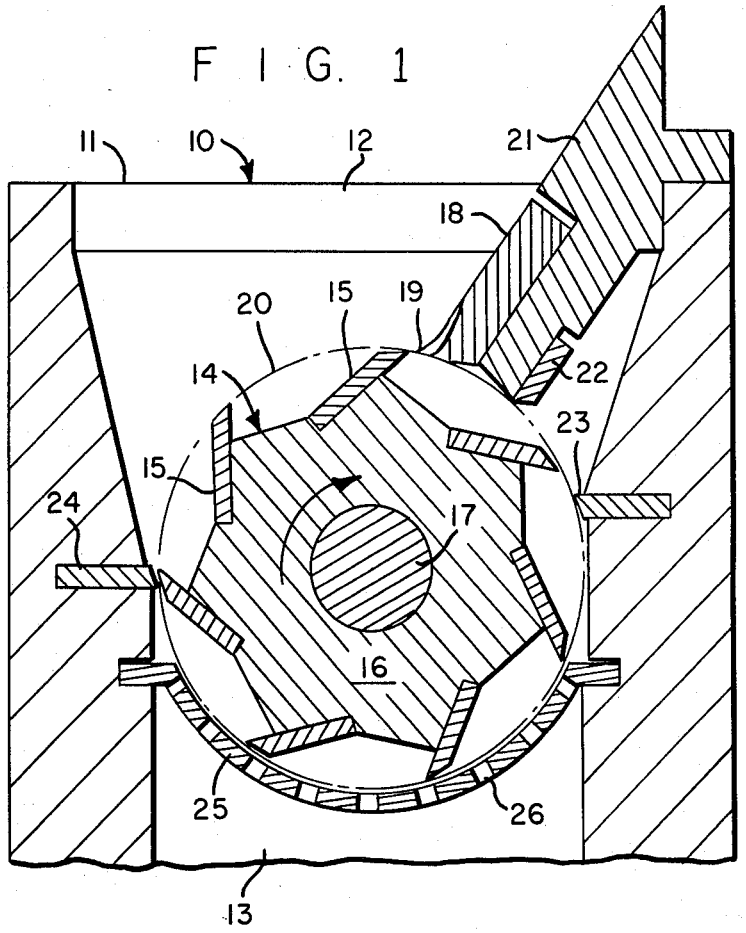
FIG. 1 is a cross-sectional representation of the shredding device of this invention.

Additional smooth-edged knives can be embedded in the housing to provide tearing action in addition to that of the combination of the flying knives 15 and stationary knife 18. Bed knives 22 and 23 have smooth cutting edges and are fixed in housing 11 at the periphery 20 of the path of the flying knives 15 immediately after serrated stationary knife 18. Bed knife 24 also has a smooth edge and is fixed in housing 11 at the periphery 20 of the path of the flying knife 15, but is located after the outlet 13. Bed knives 22, 23, and 24 are optionally used and find utility in further tearing the previously-shredded film material.

A screen 25 is mounted in housing 11 at the outlet 13 near to the periphery 20 of the path of the flying knives 15. The screen has holes 26 of a size to permit passage of shredded material of the desired size. Material of a size too large to pass holes 26 is recirculated above the screen 25 by flying knives 15 and is further torn or sheared between those knives and stationary serrated edge 19 and whichever, if any, of bed knives 22, 23, and 24 are used.

Figure 2:
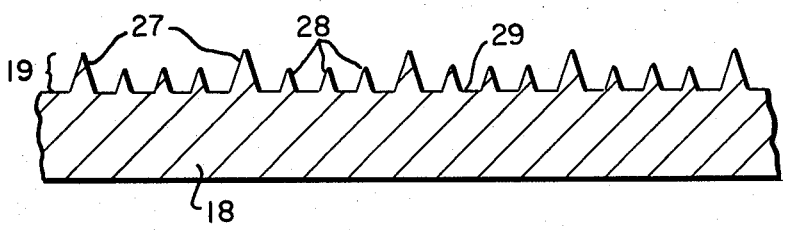
FIG. 2 is a representation of one configuration of teeth useful in the serrated knife of this invention.
Figure 3:
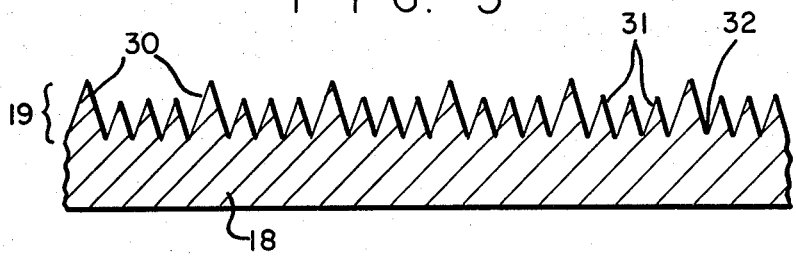
FIG. 3 is a representation of another configuration of teeth for the serrated knife.

In FIG. 2, there is shown a cross-sectional representation of one configuration of the stationary knife 18 with serrated edge 19. Serrated edge 19 is made up of sharp pointed teeth 27 and 28 spaced apart and cut to a depth so that apexes of the voids between the teeth are blunt and the roots of adjacent teeth meet in a channeled separation 29, either flat or rounded with a large radius. In FIG. 3, another configuration of the stationary knife 18 is shown in cross section; and, in FIG. 3, sharp-pointed teeth 30 and 31 of serrated edge 19 are shown to be cut to a depth so that the roots of adjacent teeth meet in a point 32.

In operation, film material to be shredded is introduced to device 10 at inlet 12. It is preferred that the film should be conveyed in a pneumatic stream wherein the air is traveling at a rate of at least 10 meters per second. Such a pneumatic stream is also useful to convey shredded material away from the device. The film material, thus introduced, is caught by flying knives 15 and pulled against the serrated edge 19 of stationary knife 18. The tooth points on the serrated edge pierce the film as tension is developed between the smooth edge of a flying knife 15 and the teeth of serrated edge 19. The film material is then torn by the serration as it is pulled into the device by flying knives 15. In order to provide more efficient and effective piercing and tearing, the forward edge of stationary knife 18 can be, and is preferably, arcuately shaped convex toward the inlet 12 and the edge 19 can project into the inlet 12.

To even more effectively pierce the film material, it has been found that it is useful to provide serrations of increased size and projection regularly spaced along serrated edge 19. In FIG. 2, teeth 27 represent such serrations and, in FIG. 3, the serrations are represented by teeth 30. Such larger teeth are not critically necessary but they have been found particularly useful for films having a thickness of greater than about 40 micrometers. When used, it has been determined that the larger teeth should be regularly spaced, they should number about 25 percent or less of the total teeth, and the apexes of such teeth should extend from about 10 to 60 percent further from the roots than the apexes of the smaller teeth.

The stationary knife 18 has an edge 19 of serrations which, if sharply pointed, provide the benefits of this invention. To be most effective, however, it has been found that the sharply pointed serrations should have an amplitude of from 0.25 to 10 centimeters and a pitch of from 0.25 to 7.5 centimeters.

While any of the above-disclosed combinations of the smooth-edged flying knives 15 and the serrated stationary blade 18 will provide the benefits of this invention, it has been found that stationary blades 18 having channel-bottomed serrations are particularly effective to tear the film material, once pierced. Blunt apexes in the voids between the teeth can be represented by a flat surface, a surface of large radius, or the like;—the extent of the deviation from sharply pointed apexes in the voids being, generally, the extent of the improvement in effectiveness of tearing action over a serrated cutting edge having sharp apexes.

The film material, having been pulled through stationary knife 18, has been substantially shredded into small pieces except for relatively small areas of the film material which may have slipped between the flying knives 15 and the stationary knife 18. That material which is shredded into pieces too large to readily pass through holes 26 is recirculated above screen 25 by flying knives 15 until reduced in size by contact with serrated edge 19 and bed knives 22, 23, and 24, if used. Thus, the film material is substantially all shredded and is passed through holes 26 in screen 25 and out of the device.

The clearances between flying knives 15 and bed knives 22, 23, and 24, when used, is from about 25 to 200 micrometers. The clearances between flying knives 15 and the stationary knife 18 at the roots (29 or 32) of the serrated edge 19, is from about 25 to 200 micrometers, while clearances between the flying knives 15 and the points (27, 28, 30, or 31) of the serrated edge 19, is from about 25 micrometers to as much as 10 millimeters;—25 to 200 micrometers being preferred.

The shaft 17 is driven to provide a flying knife edge velocity of about 10 to 30 meters per second. At that knife edge velocity, it is believed that film material can be shredded at a rate of at least 5 meters per second.

The device of this invention finds use in shredding a variety of film materials including polyacetates, polyvinyl chlorides, polyamides, cellulosics, polyesters, polycarbonates, and the like. The device has found particular utility in shredding webs of polyethylene terephthalate. Film materials in a wide range of thicknesses can be shredded in this device. In the case of polyethylene terephthalate, as an example, the thicknesses most often shredded have been in the range of about 2 to 2500 micrometers.

DESCRIPTION OF PREFERRED EMBODIMENTS

In the disclosure which follows, comparative shredding tests were conducted using serrated stationary knives as depicted in FIGS. 2 and 3 along with certain control knife configurations.

Polyethylene terephthalate film material of various thicknesses was used as the material to be shredded. In each test, a device with an inlet width of 105 centimeters was used and the film material fed thereto was 86 centimeters wide. The material was fed to the device through a pair of calibrated nip rolls at a nearly constant rate of 1.78 meters per second and the tension and jerk on the film was recorded on a strip chart recorder wired to the load cells of a three-roll tensiometer located between the nip rolls and the shredding device. Air was directed through the device at a velocity of about 20.4 meters per second.

The rotor in the device was turned at about 950 revolutions per minute to provide a knife tip velocity of about 20 meters per second and, unless otherwise specified herein, the clearance between flying knives and stationary bed knives was 100 micrometers.

The following Table presents an analysis of the jerk tension peaks on films of various thicknesses, as fed to the shredding devices. The numbers in the vertical columns under identification of the blade configurations represent the number of tension spikes greater than the tension specified in the left-hand column in one, randomly selected, second of operation.

| Film thickness (micrometers) / Tension spikes (newtons) | Control[1] | Top Bed Knife[2] | FIG. 3 Tear Knife[3] | FIG. 2 Tear Knife[4] |
|---|---|---|---|---|
| 12.7 micrometers | | | | |
| >222 newtons | 1 | 2 | 0 | 0 |
| >178 newtons | 2 | 3 | 0 | 0 |
| >133 newtons | 4 | 9 | 3 | 0 |
| >89 newtons | 3 | 9 | 16 | 0 |
| 50.8 micrometers | | | | |
| >222 newtons | 22 | 0 | 0 | 0 |
| >178 newtons | 36 | 36 | 0 | 0 |
| >133 newtons | 55 | 58 | 2 | 0 |
| >89 newtons | 80 | 80 | 18 | 5 |
| 356 micrometers | | | | |
| >222 newtons | 12 | 0 | 0 | 0 |
| >178 newtons | 48 | 4 | 0 | 0 |
| >133 newtons | 56 | 8 | 0 | 1 |

-continued

| Film thickness (micrometers) / Tension spikes (newtons) | Control[1] | Top Bed Knife[2] | FIG. 3 Tear Knife[3] | FIG. 2 Tear Knife[4] |
|---|---|---|---|---|
| >89 newtons | 71 | 33 | 0 | 2 |

[1]"Control" configuration is the device of FIG. 1 with stationary knife 18 and bed knife 22 removed. Such configuration represents the knife configuration of previously known devices having cooperating, smooth-edged blades.

[2]"Top Bed Knife" configuration is the device of FIG. 1 with only the stationary knife 18 removed. Such configuration is tested to determine that addition of one or more stationary smooth-edged blades does not materially mitigate jerk.

[3]"FIG. 3 Tear Knife" configuration is the device of FIG. 1 with stationary knife 18 having the serrations of FIG. 3, that is, wherein the teeth meet at their roots in points.

[4]"FIG. 2 Tear Knife" configuration is the device of FIG. 1 with stationary knife 18 having the serrations of FIG. 2, that is, wherein the teeth, at their roots, have a channeled separation, either flat or rounded with a large radius.

The strip charts of FIGS. 4*a*, 4*b*, 4*c*, and 4*d* provide graphical demonstration of results from the jerk analyses which have been previously tabulated herein. In those charts, the abscissa is a time axis with marked divisions equalling 0.1 second and the ordinate is a tension axis with marked divisions equalling 44.5 newtons (10 pounds force).

Figure 4A:
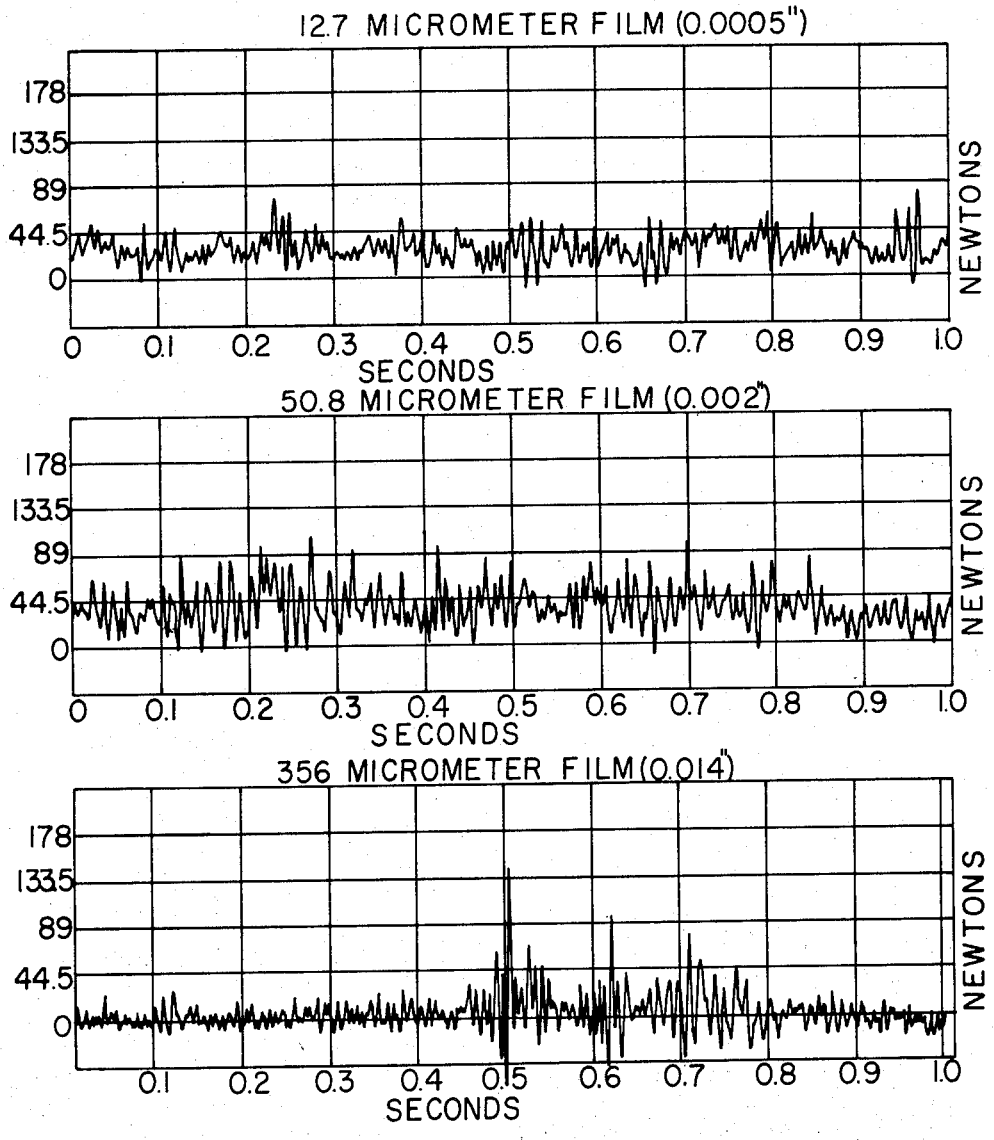
FIGS. 4*a*, 4*b*, 4*c*, and 4*d* is a set of graphical representations of the effectiveness of the device of the present invention to shred film material with reduced tendency to jerk the material.

FIG. 4*a* represents an analysis using a full complement of bed knives and a stationary knife with channel-bottomed serrations as shown in FIG. 2. ("FIG. 2 Tear Knife" in the Table).

Figure 4B:
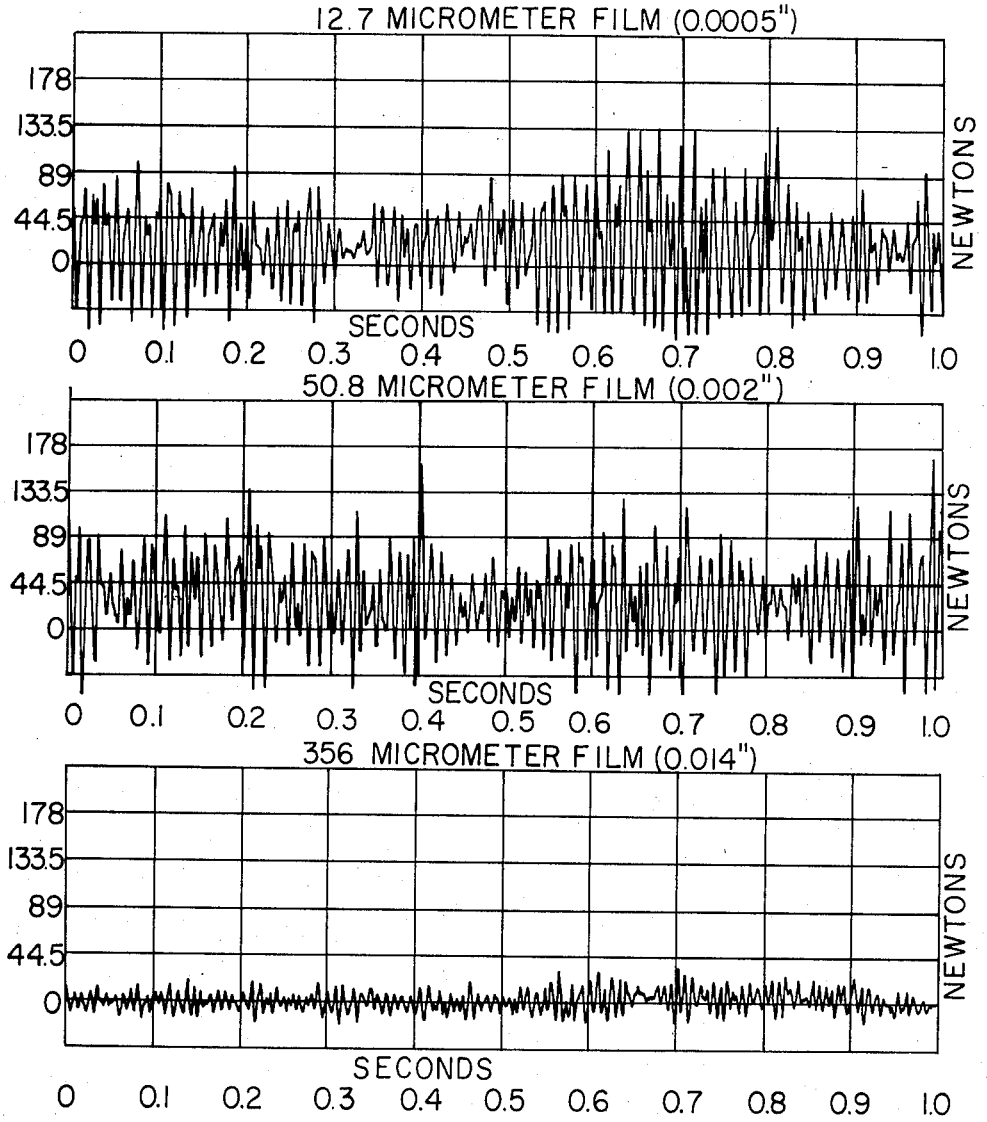

FIG. 4*b* represents an analysis using a full complement of bed knives and a stationary knife with sharp-bottomed serrations as shown in FIG. 3 ("FIG. 3 Tear Knife" in the Table).

Figure 4C:
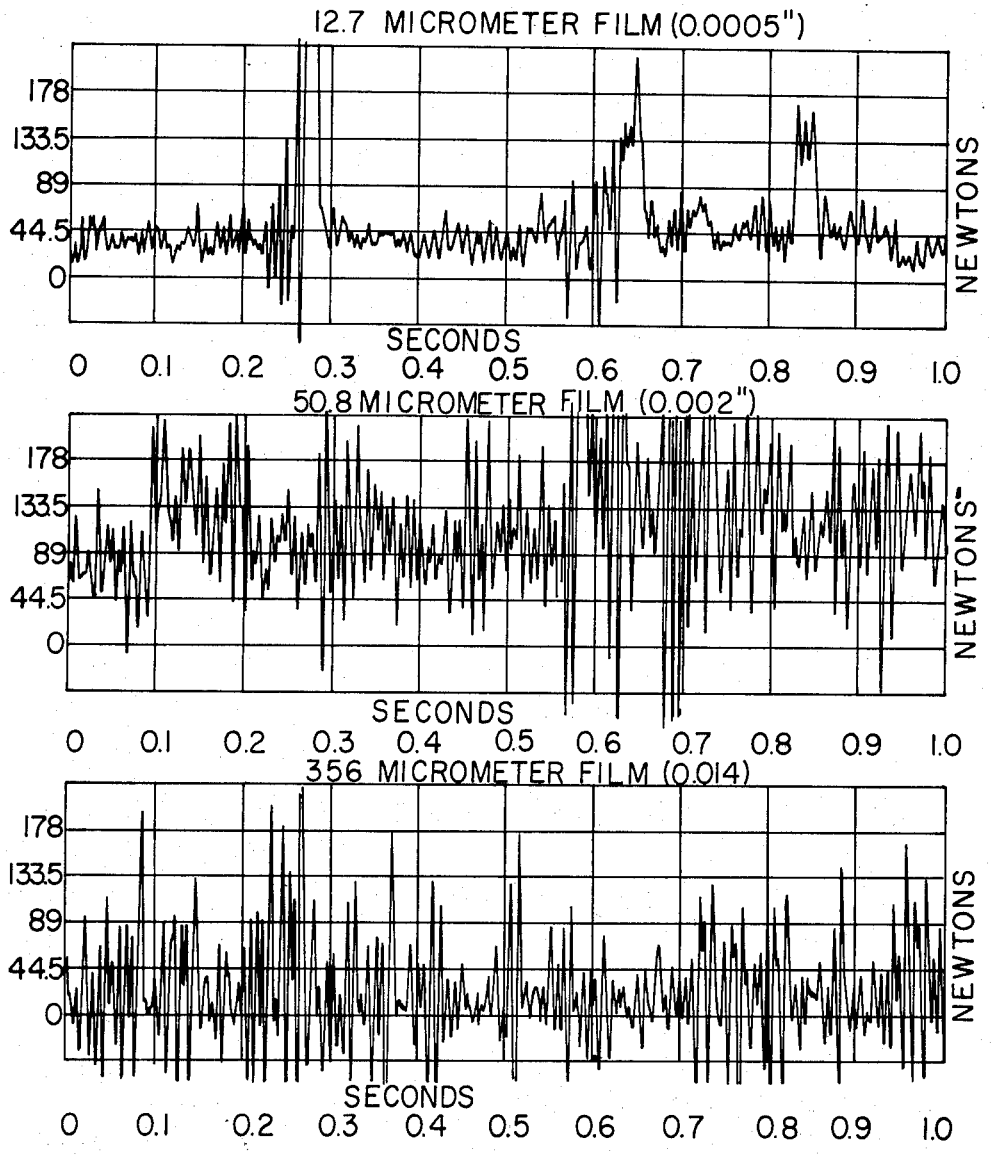

FIG. 4*c* represents an analysis using a full complement of bed knives but without any stationary knife with a serrated edge. ("Top Bed Knife" in the Table).

Figure 4D:
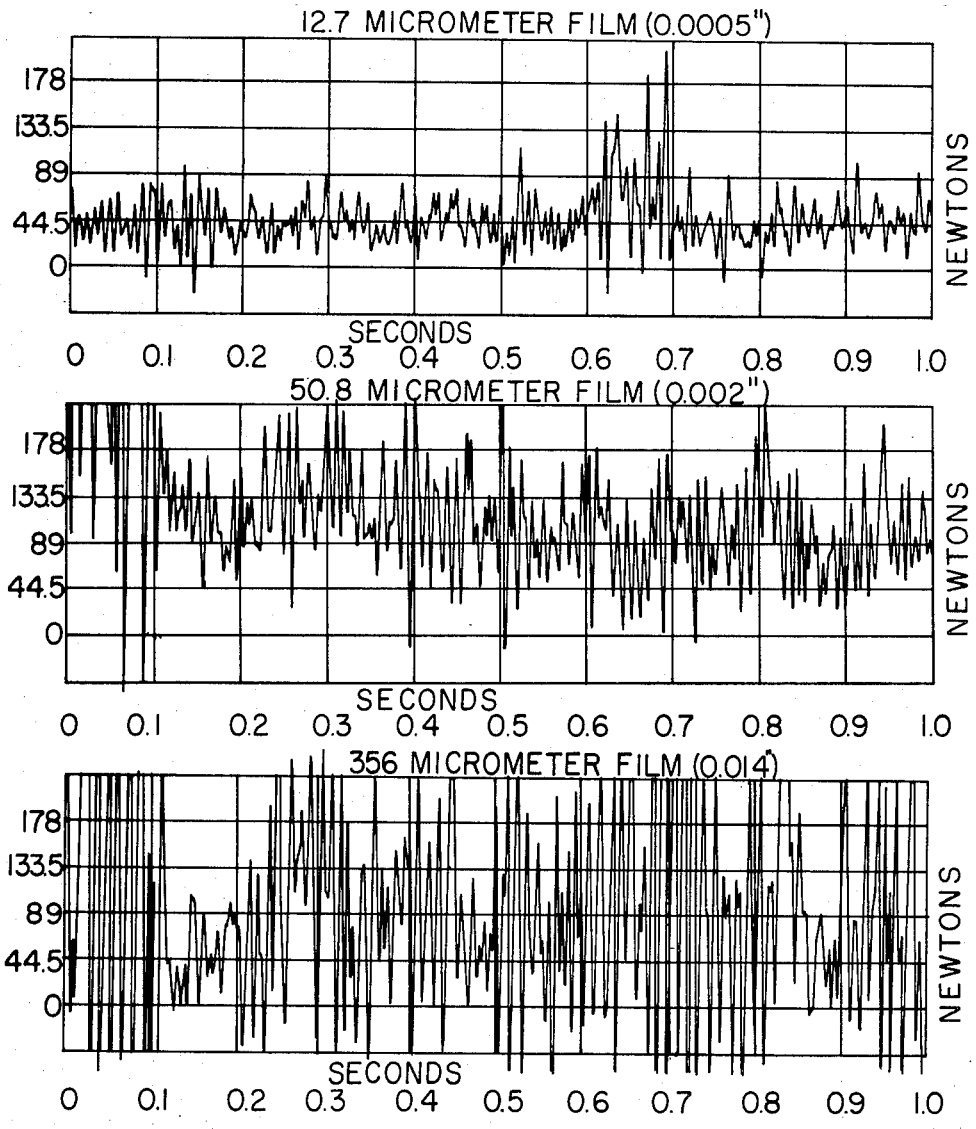

FIG. 4*d* represents an analysis using only side bed knives ("Control" in the Table).

We claim:

1. A device for shredding laterally extended film material of indefinite length comprising (a) a housing with an inlet and an outlet, (b) cutting means rotatably mounted in the housing and having a smooth cutting edge, (c) a stationary knife having a serrated edge mounted on the housing with the serrated edge positioned at the periphery of the path of the smooth cutting edge of the rotatable cutting means and with the serrated edge projecting into and directed toward the housing inlet against the direction of rotation of the rotatable cutting means.

2. The device of claim 1 wherein there is, also, (d) at least one bed knife having a smooth cutting edge and fixed in the housing at the periphery of the path of the smooth cutting edge of the rotatable cutting means.

3. The device of claim 1 wherein there is, also, (d) at least one bed knife having a smooth cutting edge and fixed in the housing at the periphery of the path, from the stationary knife to the housing outlet, of the smooth cutting edge of the rotatable cutting means.

4. The device of claim 1 wherein the serrated edge has sharply pointed teeth with blunt apexes in the voids between the teeth.

5. The device of claim 4 wherein the serrated edge includes teeth of two sizes with 25 percent or less of the teeth being larger and regularly spaced along the edge.

6. The device of claim 1 wherein the serrated edge has sharply pointed teeth of two sizes with 25 percent or less of the teeth being larger and regularly spaced along the edge.

7. The device of claim 1 wherein the stationary knife has an arcuate surface concave in the direction of the housing inlet.

* * * * *